US005622076A

United States Patent [19]

Welty

[11] Patent Number: 5,622,076

[45] Date of Patent: Apr. 22, 1997

[54] PORTABLE HYDRAULIC PUNCH

[76] Inventor: Robert E. Welty, 631 River Pl., Gadsden, Ala. 35901

[21] Appl. No.: 434,602

[22] Filed: May 4, 1995

[51] Int. Cl.[6] ..... B21J 7/28

[52] U.S. Cl. ..... 72/453.15; 72/453.18; 83/DIG. 1; 192/134

[58] Field of Search ..... 83/DIG. 1; 192/134; 72/453.15, 453.1, 453.16, 416, 409.06, 453.18

[56] References Cited

U.S. PATENT DOCUMENTS

| | | | |
|---|---|---|---|
| 3,805,658 | 4/1974 | Scott et al. | 83/DIG. 1 |
| 3,811,355 | 5/1974 | Cole | 83/DIG. 1 |
| 4,030,364 | 6/1977 | Atwood | 72/389.3 |
| 4,226,109 | 10/1980 | Nilsson | 72/453.15 |
| 4,362,196 | 12/1982 | Ferdinand et al. | 83/DIG. 1 |
| 4,793,591 | 12/1988 | Decker et al. | 251/172 |
| 5,282,378 | 2/1994 | Kimura | 72/453.15 |
| 5,287,723 | 2/1994 | Corcoran | 72/453.15 |

FOREIGN PATENT DOCUMENTS

| | | | |
|---|---|---|---|
| 806525 | 12/1958 | United Kingdom | 72/416 |

*Primary Examiner*—David Jones
*Attorney, Agent, or Firm*—James C. Nemmers

[57] ABSTRACT

A portable, hydraulically operated punch-die unit for fastening together sheet metal members without the use of separate fasteners. The unit is used in a hydraulic system utilizing a two-stage high pressure hydraulic pump having a retractor valve arrangement which allows the punch to be driven at high pressure and then retracted by generation of a vacuum. This eliminates the complexity of other ways of retracting the hydraulically driven punch, and the simplicity of the unit and the relatively few number of parts that comprise it, allow the unit to be made small and lightweight and thus easily handled.

4 Claims, 2 Drawing Sheets

PORTABLE HYDRAULIC PUNCH

BACKGROUND OF THE INVENTION

Power operated units for shaping, punching and fastening metal are known and used in a variety of applications. In recent years, metal framing members for building structures have been used with increased frequency because of the ease of construction, cost, and fire resistance of the resulting structure. For example, metal studs are typically used in commercial structures especially for interior walls. The metal framing members for such walls must of course be fastened together. At the present time, these metal framing members are fastened together using screws. This is expensive and time consuming and therefore costly.

There are presently known and used hydraulically-powered units containing a punch and die for fastening sheet metal members together without the use of separate fasteners. Standard punches and dies for this purpose are known and used so that when the two sheet metal members that are to be joined are positioned between the punch and die, the punch will deform the metal of the two members into the die and fasten them together. The known units for accomplishing this are very large and heavy weighing approximately 35 pounds. This makes the units difficult to handle and will quickly tire the user who must perform this task repeatedly during a normal work day. The units of the prior art are thus not portable in the true sense of the word, and in some instances because of their weight, they are suspended from overhead carriers to make them easier to handle. Obviously, this limits the range of motion and use of these units, and they are not suitable for many applications, including the fastening of metal framing members, such as studs.

In addition, standard framing metal studs are channel-shaped and have a limited amount of space between the legs of the channel, and thus a large, heavy punch unit is even more difficult to handle.

There is therefore a need for a truly portable, lightweight, high pressure punch and die unit for fastening sheet metal members, such as metal framing members. There is a need for such a unit that can achieve the fastening without the use of fasteners, such as screws, rivet, etc., and which unit can be manufactured and sold at a relatively low cost. To achieve this, the unit should use standard off the shelf power units and valves.

SUMMARY OF THE INVENTION

The punch-die unit of the invention is a small, hand-held and lightweight unit which forms the main component of a high pressure hydraulic system utilizing a two-stage high pressure hydraulic pump that can be located remotely from the hand-held punch-die unit. The unit of the invention has a minimum number of parts, and employs a known retractor valve arrangement which allows the punch to be driven at high pressure and then retracted by generation of a vacuum to eliminate the complexity of other ways of retracting the hydraulically driven punch. The simplicity of the unit of the invention and the relatively few number of parts that comprise it, allow the unit to be made small and lightweight and thus easily handled.

DESCRIPTION OF THE PREFERRED EMBODIMENT OF THE INVENTION

Figure 1:
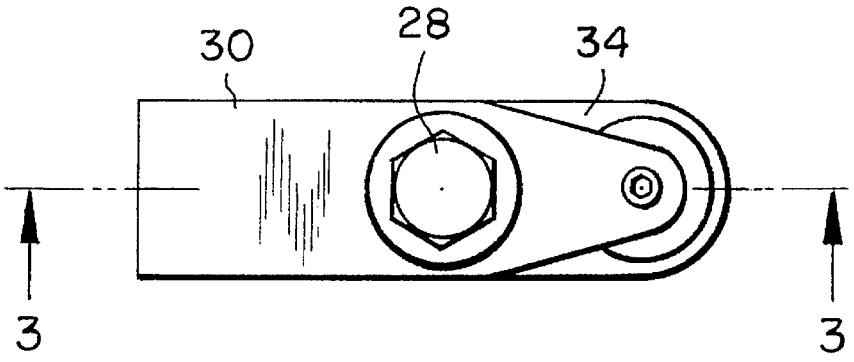
FIG. 1 is a top or plan view of a unit constructed according to the principles of the invention.
Figure 2:
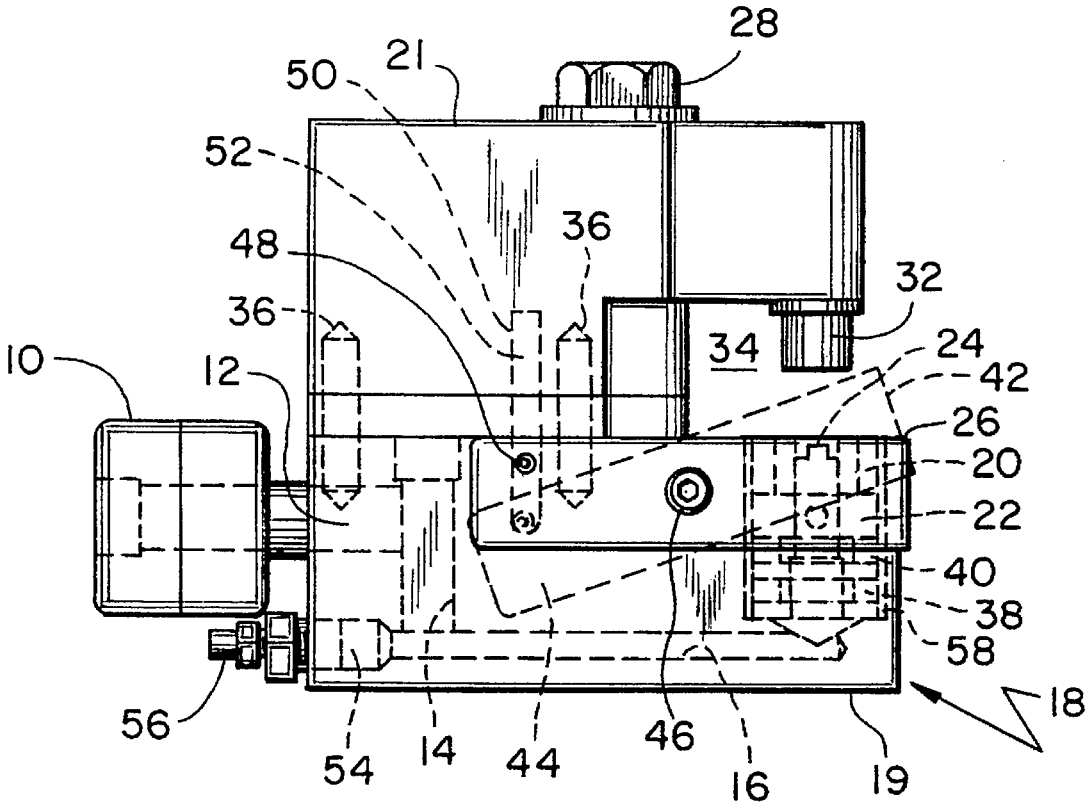
FIG. 2 is a side elevational view of the unit.
Figure 3:
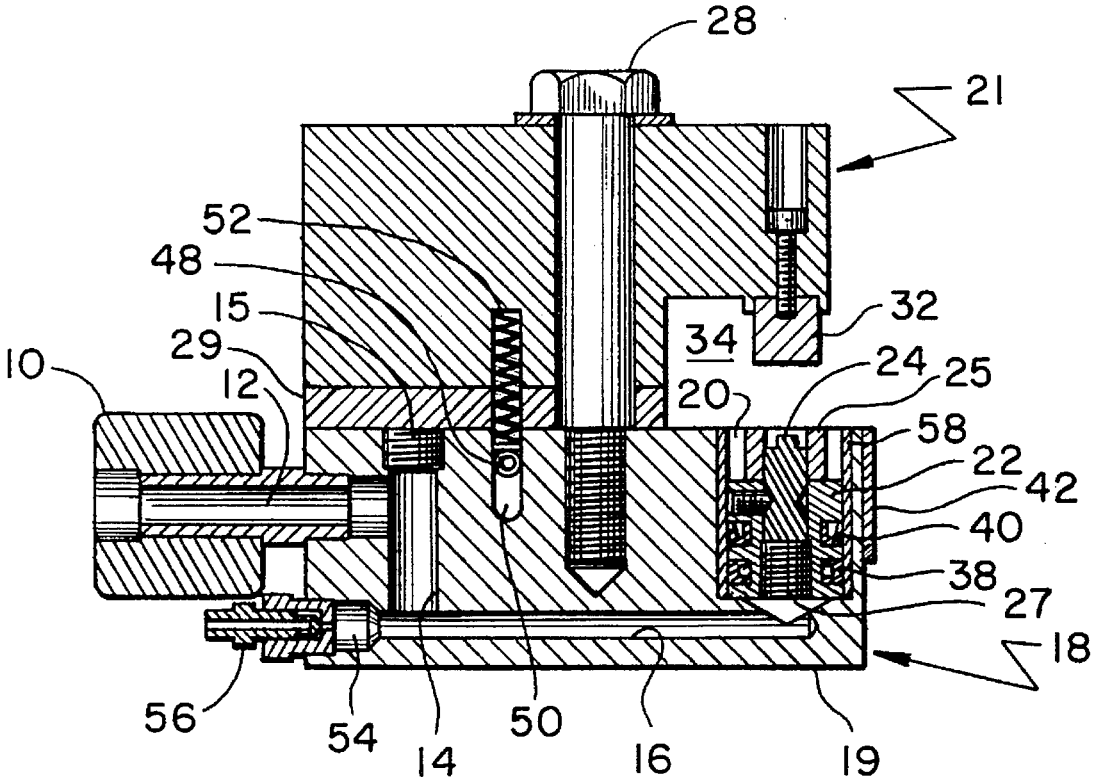
FIG. 3 is a sectional view taken on the Line 3—3 of FIG. 1 to illustrate the internal workings of the unit.

The drawings illustrate a punch-die unit constructed according to the principles of the invention. It should be understood, however, that it must be supplied by a high pressure hydraulic fluid from a two-stage hydraulic pump. In order to provide the necessary force to the punch and die to squeeze together and thus fasten sheet metal framing members of a thickness of 18 to 30 gage, the unit of the invention requires hydraulic pressure of approximately 5,800 psi to produce the three tons of pressure at the punch and die. Electrically powered two-stage hydraulic pumps that can supply such pressure and known and commercially available. One suitable such pump is currently being marketed under the trademark "SIMPLEX" which is a part of the VL-Series electric power units manufactured and sold by SIMPLEX Division of Tempelton-Kenley. These commercially available power units are available with a special retractor valve which operates to draw hydraulic fluid out of any single acting cylinder, and in the retract position, the retractor valve will generate 10–12 psi of vacuum, which is sufficient to fully retract a single acting piston. The foregoing referred to "SIMPLEX" power unit is available with such a valve.

The punch-die unit of the invention is connected to the high pressure line from the hydraulic pump or power unit by a standard rotary union 10 which provides high pressure hydraulic fluid to the unit of the invention through a first passageway 12 which is connected to a vertical passageway 14 and then to a second horizontal passageway 16 all formed internally in the lower portion 19 of the main body 18 of the unit of the invention. Plug 15 seals off passageway 14 after it is formed in main body 18.

The horizontal passageway 16 is connected to vertically extending cylinder 20 containing a piston 22 carrying a suitable punch 24 that will thus be forced upwardly and out of the top surface 26 of the main body 18 when the piston 22 is actuated by the application of high pressure fluid. Punch 24 is provided with a stripper 25 and a back-up plug 27 is threaded into the lower end of piston 22.

Connected to the lower portion of main body 18 by a suitable threaded fastener 28 is an intermediate member 29 and an upper portion 21 to which is affixed a suitable die 32. The die 32 is affixed to the upper portion 21 in alignment with the punch 24 so that when the punch is driven upwardly the punch 24 and die 32 will perform the necessary deformation of any material positioned between them. To accommodate the insertion of the sheet metal members that are to be fastened, an open space 34 is provided between the upper portion 21 and lower portion 19 of the main body 18 and inwardly of the die 32. To facilitate assembly of the unit and assure proper alignment of the die 32 and punch 24, suitable alignment pins 36 are preferably provided in respective openings in the lower portion 19 of main body 18, intermediate member 29 and upper portion 21 of the main body 18.

To prevent leakage of the hydraulic fluid and maintain the necessary high pressure in the cylinder 20 the piston 22 is provided with an annular high pressure seal 38 of any suitable type.

As previously mentioned, the hydraulic power unit or pump with which the punch-die unit of the invention is designed to be used is provided with a retractor valve or other suitable means that generates a vacuum in the retracted position. This negative pressure is then used to retract the piston 22 without the necessity or use of a return spring or other device. To provide for retraction of the piston 22 when negative pressure is created in the passageway 16 by the hydraulic pump, the piston 22 also contains a U-cup vacuum seal 40 located downstream from the high pressure seal 38.

As an added safety feature, a U-shaped finger guard 42 extends around and in front of the open space 34 between the punch 24 and die 32. The finger guard thus has a pair of legs 44, one along each side of the main body 18, which legs 44 are connected to the lower portion 19 of the main body 18 by a pivot bolt 46. The free ends of the legs 44 also are connected by a transversely extending pin 48 which is moveable upwardly and downwardly in a slot 50 formed in the lower and upper portions 19 and 21, the pin 48 being biased downwardly by a spring 52. Thus, the finger guard 42 will close off the open space 34 between the punch 24 and die 32 to prevent the operator from accidentally placing his or her fingers between the punch and die. However, the finger guard 42 is easily pushed out of the way against the bias of the spring 52 when the sheet metal members to be fastened are inserted into the open space 34.

The lower portion 19 of the main body 18 also contains a passageway 54 connected to a bleed port 56 so that any air that should enter the system can be easily bled off, since air is compressible and would render the unit inoperable.

The lower portion 19 of the main body 18, the intermediate member 29 and upper portion 21 are preferably made of a lightweight material such as aluminum. If so, the cylinder 20 is preferably provided with a sleeve 58 formed of a wear resistant material such as stainless steel. Preferably, piston 22 is made of brass. Punch 24 and die 32 are standard commercially available components. When assembled, the entire unit of the invention weighs approximately four pounds. It is thus easily handled for repeated use by an operator.

In operation, after the metal components to be joined are positioned between the punch 24 and die 32, the operator will trigger a suitable switch (not shown) which conveniently can be located on a gripper handle (not shown) attached to the punch-die unit of the invention. When the switch is actuated, a solenoid valve comprising a part of the hydraulic pump power unit will cause high pressure to be applied to the piston 22 to drive it upwardly toward the die thus deforming the metal of the components to be fastened and fastening them together. A solenoid valve that forms a part of the hydraulic pump power unit will then move to a retract position generating a vacuum to retract the piston 22 and allow the now joined metal components to be withdrawn. The process is thus repeated each time two components are positioned between the punch 24 and die 32 and thus ready to be joined.

The unit of the invention thus provides a light weight, small and truly portable fastener that can be used in any application where two sheet metal members are to be joined together. Use of the unit of the invention eliminates the use of separate fasteners and thus is considerably less costly to use.

Having thus described the invention, it will be evident to those skilled in the art that various revisions and modifications can be made to the preferred embodiment described herein without departing from the spirit and scope of the invention. It is my intention however that all such revisions and modifications that are obvious to persons skilled in the art will be included within the scope of the following claims.

What is claimed is as follows:

1. A portable, hydraulically operated punch-die unit f or fastening together sheet metal members without the use of separate fasteners when used in a hydraulic system having a two-stage high pressure hydraulic pump and a retractor valve capable of both supplying high pressure hydraulic fluid to the unit and generating a negative pressure in the unit, said unit comprising: a main body having an upper portion and a lower portion with an open space formed between said portions; a die supported by the upper portion and extending into the open space; an inlet formed in the main body for connecting the unit to a high pressure hydraulic pump; a cylinder formed in the lower portion of the main body beneath the open space; a fluid passageway connecting the cylinder and the inlet; a piston movable in the cylinder; a punch connected to and movable with the piston; the cylinder, piston and punch being located so that the punch is in alignment with the die so that when the piston moves toward the die the punch will engage the die in proper alignment; a first high pressure seal around the piston and engageable with the cylinder; and a second U-cup vacuum seal around the piston downstream from the first high pressure seal and engageable with the cylinder; the second vacuum seal providing for retraction of the piston and thus the punch when a negative pressure is applied-to the piston through the passageway.

2. The portable, hydraulically operated punch-die unit of claim 1 in which the passageway is connected to an air bleed valve.

3. The portable, hydraulically operated punch-die unit of claim 1 in which a finger guard is connected to the main body and extends around the open space in a guard position to prevent the accidental insertion of a user's finger between the punch and die, and means is provided to bias the finger guard into the guard position.

4. The portable, hydraulically operated punch-die unit of claim 3 in which the finger guard is U-shaped and has legs extending along the main body and pivotally connected to the main body, the finger guard having a guard portion extending between the legs and extending around the open space.

* * * * *